US007659525B2

(12) United States Patent
Ogawa et al.

(10) Patent No.: US 7,659,525 B2
(45) Date of Patent: Feb. 9, 2010

(54) APPARATUS FOR AND METHOD OF RECORDING IMAGE

(75) Inventors: Hideaki Ogawa, Kyoto (JP); Hiroshi Okamoto, Kyoto (JP); Keisuke Hirayama, Kyoto (JP); Yuji Kurokawa, Kyoto (JP); Hiroyuki Fujisawa, Kyoto (JP); Ichiro Watanabe, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 284 days.

(21) Appl. No.: 11/723,578

(22) Filed: Mar. 21, 2007

(65) Prior Publication Data

US 2007/0224527 A1 Sep. 27, 2007

(30) Foreign Application Priority Data

Mar. 24, 2006 (JP) ..... 2006-82703

(51) Int. Cl.
*G03C 5/00* (2006.01)

(52) U.S. Cl. ..... 250/492.1; 250/205; 250/492.2; 250/492.21; 355/83; 355/84; 347/224; 347/236; 347/238; 347/246; 347/248

(58) Field of Classification Search ..... 250/205, 250/492.1, 492.2, 492.21; 355/83, 84; 430/30; 347/224, 236, 234, 238, 246, 248
See application file for complete search history.

(56) References Cited

U.S. PATENT DOCUMENTS 5,430,469 A * 7/1995 Shioya et al. ..... 347/15
6,121,993 A * 9/2000 Maekawara et al. ..... 347/236
6,683,640 B1 * 1/2004 Sasaki et al. ..... 347/253
6,690,636 B1 * 2/2004 Marchant ..... 369/97
6,784,912 B2 8/2004 Beier et al.

(Continued)

FOREIGN PATENT DOCUMENTS

EP 0 517 519 A 12/1992

(Continued)

OTHER PUBLICATIONS

European Search Report issued in European Patent Application No. EP 07005978.7-2304/1844942, dated Oct. 1, 2008.

*Primary Examiner*—David A Vanore
*Assistant Examiner*—Michael J Logie
(74) *Attorney, Agent, or Firm*—McDermott Will & Emery LLP

(57) ABSTRACT

An image recording apparatus (1) causes a recording head (20) to move through a distance corresponding to one half of the recording width of the recording head (20) in a sub-scanning direction each time a recording drum (10) makes one rotation. This, light emitting devices (23, 24) record two line data in advance, and thereafter following light emitting devices (21, 22) record the same line data repeatedly at the same position. This increases the energy of laser light beams given to a recording position on a printing plate (P) to accomplish the recording of an image with reliability. The recording speed is not extremely decreased because not all light emitting devices (21 to 24) are used to make the repeated recordings at the same position on the printing plate (P). Further, the construction of optical systems and driving systems in the image recording apparatus is not complicated.

7 Claims, 12 Drawing Sheets

U.S. PATENT DOCUMENTS

| | | | | |
|---|---|---|---|---|
| 7,030,899 | B2 * | 4/2006 | Hoshino et al. | 347/236 |
| 2002/0054203 | A1 * | 5/2002 | Yamada et al. | 347/232 |
| 2002/0064317 | A1 * | 5/2002 | Hirawa | 382/305 |
| 2002/0158936 | A1 * | 10/2002 | Otsuka et al. | 347/19 |
| 2003/0048467 | A1 * | 3/2003 | Okamoto et al. | 358/1.12 |
| 2003/0085985 | A1 * | 5/2003 | Kataoka et al. | 347/246 |
| 2003/0106448 | A1 * | 6/2003 | Uemura | 101/477 |
| 2003/0177921 | A1 * | 9/2003 | Kitagawa | 101/216 |
| 2004/0240922 | A1 * | 12/2004 | Oka et al. | 400/82 |
| 2004/0263875 | A1 * | 12/2004 | Okamoto | 358/1.8 |
| 2005/0111016 | A1 * | 5/2005 | Yoneyama et al. | 358/1.9 |
| 2006/0017801 | A1 * | 1/2006 | Suzuki et al. | 347/248 |
| 2006/0066701 | A1 * | 3/2006 | Hirakawa | 347/101 |
| 2006/0268308 | A1 * | 11/2006 | Suzuki et al. | 358/1.13 |

FOREIGN PATENT DOCUMENTS

| | | |
|---|---|---|
| EP | 0 589 669 A | 3/1994 |
| EP | 0 783 223 A | 7/1997 |
| JP | 11-500962 | 1/1999 |
| JP | 2000-043318 | 2/2000 |
| JP | 3556204 | 5/2004 |

* cited by examiner

APPARATUS FOR AND METHOD OF RECORDING IMAGE

BACKGROUND OF THE INVENTION

1. Field of the Invention

The present invention relates to an image recording apparatus for recording an image on a recording medium by scanning a surface of the recording medium with a light beam.

2. Description of the Background Art

An image recording apparatus for recording an image on a surface of a printing plate by scanning the surface of the printing plate with a light beam has conventionally been known. For example, an image recording apparatus for recording an image on a surface of a printing plate for use in flexographic printing and letterpress printing has been known. The surface of the printing plate for use in flexographic printing and letterpress printing is made of a photosensitive resin. When irradiated with a light beam, the surface of the printing plate becomes uneven, whereby an image is recorded on the printing plate.

For the recording of an image on such a printing plate with reliability, it is desirable to increase the energy given from the light beam to a recording location on the printing plate. For the increase in the energy given from the light beam, National Publication of Translation No. 11-500962 (1999) discloses the technique of irradiating a printing plate with a plurality of laser light beams brought together on the same optical axis, and Japanese Patent No. 3556204 discloses the technique of recording at the same position on a printing plate sequentially with a plurality of beams.

The technique disclosed in National Publication of Translation No. 11-500962, however, requires the provision of an optical system for bringing the plurality of laser light beams together to present a problem in that mechanical parts including the optical system have a complicated structure. The technique disclosed in Japanese Patent No. 3556204 presents the problem of significant decrease in image recording speed because all of the beams sequentially impinge upon the same position on the printing plate. Increasing the speed of rotation of a recording drum and the speed of feed of a recording head can improve the image recording speed. However, there are definite limits to the increase in the speed of operation of systems for driving the recording drum, the recording head and the like.

SUMMARY OF THE INVENTION

The present invention is intended for an image recording apparatus for recording an image on a recording medium by scanning a surface of the recording medium with a light beam.

According to the present invention, the image recording apparatus comprises: a recording head including a plurality of light sources each for emitting a light beam toward the recording medium; a moving part for moving the recording head relative to the recording medium in a main scanning direction and in a sub-scanning direction orthogonal to the main scanning direction; and a controller for controlling the moving part so that the recording head moves through a distance corresponding to one N-th of a recording width of the recording head in the sub-scanning direction each time the recording head makes a single scan in the main scanning direction, to thereby cause the recording head to make N repeated recordings at the same position on the recording medium, where N is an integer not less than two and different from the number of the light sources.

This increases the energy of the light beams given to the recording position on the recording medium to accomplish the recording of an image with reliability. The recording speed is not extremely decreased because not all light sources are used to make the repeated recordings at the same position on the recording medium. Further, the construction of optical systems and driving systems in the image recording apparatus is not complicated.

Preferably, the light sources are arranged in the sub-scanning direction in the recording head, and the integer N is a submultiple of the number of the light sources included in the recording head.

The plurality of light sources included in the recording head are divided into N groups, and each of the N groups makes repeated recordings at the same location on the recording medium. This enables all of the light sources included in the recording head to be used without any useless remainder light source.

Preferably, the image recording apparatus further comprises a setting part for setting the value of the integer N.

The number of repeated recordings on the recording medium is settable at any value depending on various conditions.

Preferably, the setting part sets the value of the integer N, based on information about the sensitivity of the recording medium or a given recording intensity.

The image recording apparatus is capable of setting the value of N at a high value to increase the number of repeated recordings when the sensitivity of the recording medium is low or when a high recording intensity is required. The image recording apparatus is also capable of setting the value of N at a low value to improve the image recording speed when the sensitivity of the recording medium is high or when a not-so-high recording intensity is required.

Preferably, the image recording apparatus further comprises a distribution part for distributing data to the light sources so that the recording head records the same data at the same position on the recording medium.

This avoids the recording of different data at the same position on the recording medium, to suitably accomplish the repeated recordings.

Preferably, the distribution part includes (N+1) buffers for temporarily holding data to provide the data to the light sources, and performs the process of writing the same data into N out of the (N+1) buffers and reading data from the remaining one buffer while changing the combination of the N buffers in order.

This accomplishes the provision of the same data repeatedly N times to the plurality of light sources included in the recording head.

Preferably, each of the light sources is capable of continuously changing the intensity of the light beam.

This accomplishes the recording of a multi-level gradation image on the recording medium.

Preferably, the controller is capable of switching between a first mode in which the controller controls the moving part so that the recording head moves through a distance corresponding to the recording width of the recording head in the sub-scanning direction each time the recording head makes a single scan in the main scanning direction, and a second mode in which the controller controls the moving part so that the recording head moves through a distance corresponding to one N-th of the recording width of the recording head in the sub-scanning direction each time the recording head makes a single scan in the main scanning direction.

Whether to make the repeated recording on the recording medium or not is selectable depending on various conditions.

Preferably, the controller is capable of switching between a mode in which the controller controls the moving part so that the recording head moves through a distance corresponding to one N-th of the recording width of the recording head in the sub-scanning direction each time the recording head makes a single scan in the main scanning direction, and another mode in which the controller controls the moving part so that the recording head moves through a distance corresponding to one M-th of the recording width of the recording head in the sub-scanning direction each time the recording head makes a single scan in the main scanning direction, to thereby cause the recording head to make M repeated recordings at the same position on the recording medium, where M is the number of the light sources arranged in the sub-scanning direction.

The number of repeated recordings on the recording medium is selectable depending on various conditions.

Preferably, the light sources are arranged in a two-dimensional array extending in the main scanning direction and in the sub-scanning direction in the recording head, and the recording head uses some of the light sources different in main scanning position from each other to make repeated recordings at the same position on the recording medium.

This alleviates variations in recording intensity resulting from the different main scanning positions of the light sources in the recording head.

Preferably, the light sources are distributed to and disposed in a predetermined number of main scanning positions in the recording head, and the recording head uses at least some of the light sources disposed in all of the main scanning positions to make repeated recordings at the same position on the recording medium.

This more satisfactorily alleviates variations in recording intensity resulting from the different main scanning positions of the light sources in the recording head.

According to another aspect of the present invention, the image recording apparatus comprises: a recording head including a plurality of light sources each for emitting a light beam toward the recording medium; a moving part for moving the recording head relative to the recording medium in a main scanning direction and in a sub-scanning direction orthogonal to the main scanning direction; and a controller for controlling the moving part, the controller being capable of switching between a mode in which the controller controls the moving part so that the recording head moves through a distance corresponding to a recording width of the recording head in the sub-scanning direction each time the recording head makes a single scan in the main scanning direction, and another mode in which the controller controls the moving part so that the recording head moves through a distance corresponding to one M-th of the recording width of the recording head in the sub-scanning direction each time the recording head makes a single scan in the main scanning direction, to thereby cause the recording head to make M repeated recordings at the same position on the recording medium, where M is the number of the light sources arranged in the sub-scanning direction.

The number of repeated recordings on the recording medium is selectable depending on various conditions.

The present invention is also intended for a method of recording an image on a recording medium by scanning a surface of the recording medium with a light beam.

It is therefore an object of the present invention to provide an image recording apparatus capable of improving the intensity of recording on a recording medium without complicated construction of the mechanical parts of the image recording apparatus and without extreme decrease in image recording speed.

These and other objects, features, aspects and advantages of the present invention will become more apparent from the following detailed description of the present invention when taken in conjunction with the accompanying drawings.

DESCRIPTION OF THE PREFERRED EMBODIMENTS

A preferred embodiment according to the present invention will now be described with reference to the drawings.

1. CONSTRUCTION OF IMAGE RECORDING APPARATUS

Figure 1:
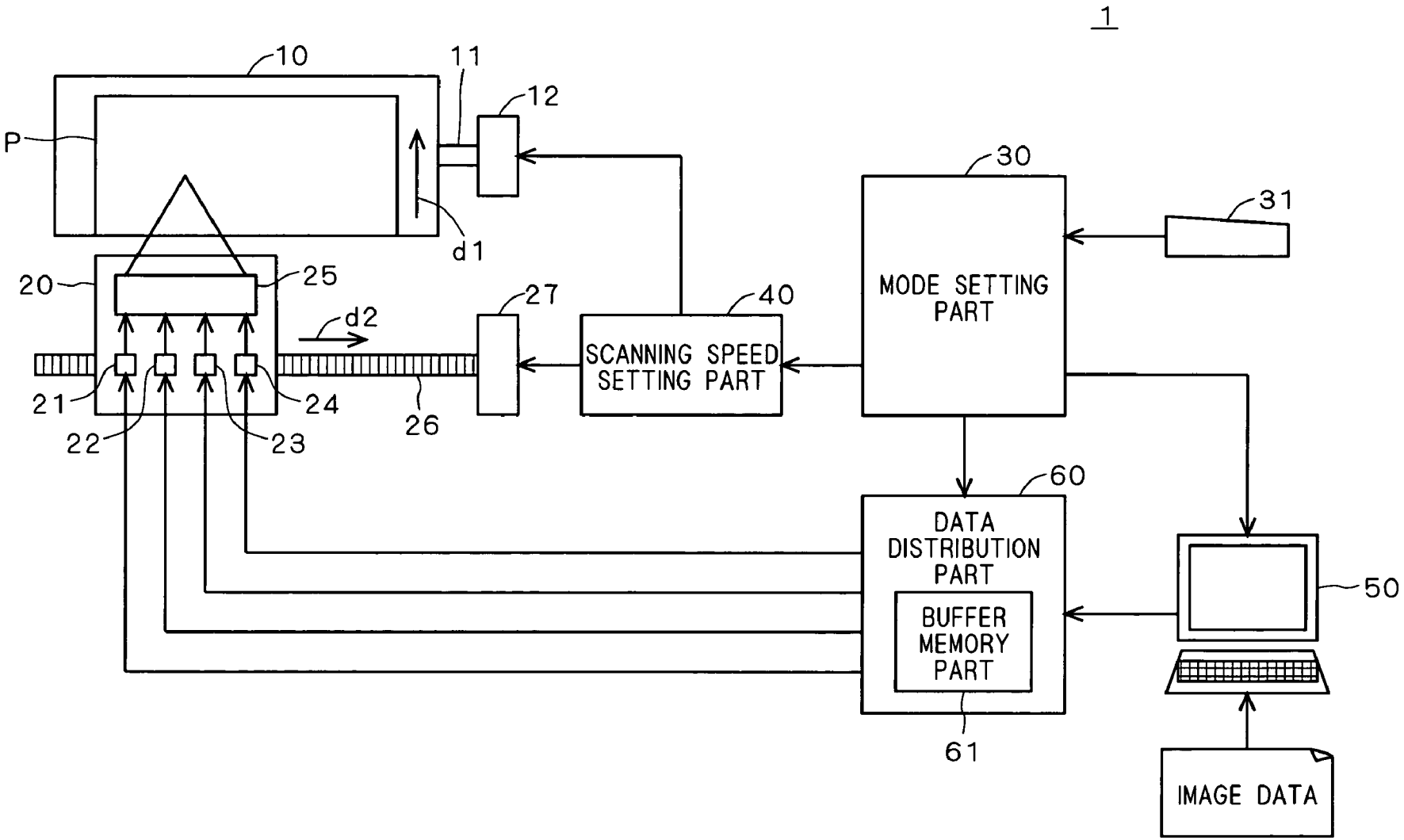
FIG. 1 shows the construction of an image recording apparatus according to a preferred embodiment of the present invention.

FIG. 1 shows the construction of an image recording apparatus 1 according to a preferred embodiment of the present invention. The image recording apparatus 1 is an apparatus for recording an image on a printing plate P by scanning a surface of the printing plate P with a light beam. As shown in FIG. 1, the image recording apparatus 1 principally includes a recording drum 10, a recording head 20, a mode setting part 30, a scanning speed setting part 40, a front end PC (personal computer) 50, and a data distribution part 60.

The recording drum 10 is a rotation mechanism for moving the printing plate P serving as an image recording medium in a main scanning direction (or in the direction indicated by the arrow d1 in FIG. 1). The printing plate P is mounted on a cylindrical outer peripheral surface of the recording drum 10 by a clamp member and the like. The recording drum 10 has a rotary shaft 11 connected to a main shaft motor 12. Thus, when the main shaft motor 12 is operated, the recording drum 10 rotates together with the rotary shaft 11 to thereby move the printing plate P in the main scanning direction. For example, a printing plate made of a photosensitive resin for use in flexographic printing and letterpress printing is used as the printing plate P.

The recording head 20 is a mechanism for directing laser light beams onto the printing plate P mounted on the recording drum 10 while moving in a sub-scanning direction (or in the direction indicated by the arrow d2 in FIG. 1) parallel to the rotary shaft 11 of the recording drum 10. The recording head 20 includes four light emitting devices 21 to 24 arranged in the sub-scanning direction. The light emitting devices 21 to 24 are individually controlled to turn on or off, based on data provided thereto. The laser light beams emitted from the respective light emitting devices 21 to 24 pass through an optical system 25 to form an image on the surface of the printing plate P mounted on the recording drum 10. The recording head 20 is in threaded engagement with a ball screw 26 extending in the sub-scanning direction, and the ball screw 26 is connected to a sub-shaft motor 27. Thus, when the sub-shaft motor 27 is operated, the ball screw 26 rotates to thereby move the recording head 20 in the sub-scanning direction.

In this image recording apparatus 1, as described above, the recording head 20 is moved in the sub-scanning direction while the recording drum 10 is rotated in the main scanning direction. This enables the recording head 20 to move in the main scanning direction and in the sub-scanning direction relative to the printing plate P. The process of moving the recording head 20 in the main scanning direction relative to the printing plate P is hereinafter referred to simply as "main scanning (or main scan)," and the process of moving the recording head 20 in the sub-scanning direction relative to the printing plate P is referred to simply as "sub-scanning (or sub-scan)."

The mode setting part 30 is a processor for setting a recording mode for the printing plate P. The image recording apparatus 1 has a first recording mode in which only one recording is made on the printing plate P, a second recording mode in which two repeated recordings are made on the printing plate P, and a third recording mode in which four repeated recordings are made on the printing plate P. The mode setting part 30 selects one recording mode from among the first, second and third recording modes, based on information (information about the sensitivity of the printing plate P, a recording intensity, and the like) inputted from an input part 31. For example, when the sensitivity of the printing plate P is low or a high recording intensity is required, the mode setting part 30 selects the second or third recording mode. When the sensitivity of the printing plate P is high or a not-so-high recording intensity is required, the mode setting part 30 selects the first recording mode. The mode setting part 30 sends information about the selected recording mode to the scanning speed setting part 40, the front end PC 50 and the data distribution part 60. The mode setting part 30, and the scanning speed setting part 40 and data distribution part 60 to be described later are implemented by, for example, a combination of electronic circuits.

The information about the recording intensity refers to information about how deep and how wide scanning lines are required to be engraved for an image to be recorded, and the like when the printing plate P is a relief plate or an intaglio plate. The information about the recording intensity refers to information about the density and width of scanning lines required for an image to be recorded, and the like when the printing plate P is a lithographic plate.

The scanning speed setting part 40 is a processor for controlling the rotational speeds of the main shaft motor 12 and the sub-shaft motor 27 to thereby control the main scanning speed and the sub-scanning speed of the image recording apparatus 1. Upon receipt of the information about the recording mode from the mode setting part 30, the scanning speed setting part 40 sets the rotational speeds of the main shaft motor 12 and the sub-shaft motor 27 so that the recording drum 10 and the recording head 20 operate at respective speeds corresponding to the recording mode. The scanning speed setting part 40 operates the main shaft motor 12 and the sub-shaft motor 27 at the set rotational speeds.

The front end PC 50 is a data processor for providing image data given from the outside to the data distribution part 60. The front end PC 50 is constructed by a computer including a CPU, and a memory. The front end PC 50 divides the image data given thereto into a plurality of strip-shaped image data (referred to hereinafter as line data) to be recorded during a single main scan by the light emitting devices 21 to 24 to provide the plurality of line data to the data distribution part 60. The image data may be either a set of binary data to be recorded by only turning on and off the light emitting devices 21 to 24 or a set of multi-level data to be recorded by continuously changing the light emission intensity of the light emitting devices 21 to 24.

The data distribution part 60 is a processor for distributing data to a plurality of light sources so that the recording head 20 records data at each corresponding position on the printing plate P. The data distribution part 60 includes a buffer memory part 61 for writing and reading data. The data distribution part 60 temporarily stores a multiplicity of line data provided from the front end PC 50 in the buffer memory part 61. The data distribution part 60 sends the plurality of line data in a predetermined sequence to the light emitting devices 21 to 24 in response to the information about the recording mode provided from the mode setting part 30. The buffer memory part 61 includes buffer memories 61*a* to 61*e* to be described later.

2. BASIC OPERATION OF IMAGE RECORDING APPARATUS

The image recording apparatus 1 having the above-mentioned construction records an image on the printing plate P in a manner to be described below. First, an operator manipulates the input part 31 to enter the sensitivity of the printing plate P to be used or a desired recording intensity. Then, the mode setting part 30 selects one of the first, second and third recording modes, based on the inputted information about the sensitivity of the printing plate P or the recording intensity. The mode setting part 30 sends the information about the selected recording mode to the scanning speed setting part 40, the front end PC 50, and the data distribution part 60.

Next, when image data is provided from the outside to the front end PC 50, the front end PC 50 divides the image data provided thereto into a plurality of line data to send the plurality of line data to the data distribution part 60 at a transfer rate suitable for the set recording mode. The data distribution part 60 temporarily stores the plurality of line data in the buffer memory part 61, and sends the plurality of line data in a predetermined sequence suitable for the set recording mode to the light emitting devices 21 to 24. Each of the light emitting devices 21 to 24 emits a laser light source individually, based on the line data provided thereto.

The scanning speed setting part 40, on the other hand, controls the main shaft motor 12 and the sub-shaft motor 27 in accordance with the recording mode received from the mode setting part 30 to thereby bring the recording drum 10 and the recording head 20 into operation. Thus, the laser light beams emitted from the light emitting devices 21 to 24 scan the surface of the printing plate P to record an image on the printing plate P.

Described above is the basic operation of the image recording apparatus 1. More specifically, the details of processing in the scanning speed setting part 40 and in the data distribution part 60 differ depending on the recording mode selected in the mode setting part 30. The details of processing specific to the recording modes will be described later.

The angle of inclination of the scanning lines with respect to the rotary shaft 11 is changed depending on the selected recording mode because there is a difference between the recording modes in the number of scanning lines recorded per rotation of the recording drum 10. Specifically, the scanning lines inclined at an angle θ in the sub-scanning direction are sequentially recorded on the printing plate P, the angle θ of inclination being defined to satisfy $\tan^{-1}\theta=r/w$ where r is the circumference of the recording drum 10, and w is a recording width per rotation of the recording drum 10. Thus, when the data distribution part 60 stores the plurality of line data in the buffer memory part 61, the data distribution part 60 writes the line data subjected to a correction such that the line data are previously inclined at the angle θ in the direction opposite from the sub-scanning direction in order to record an image finally not inclined on the printing plate P. In other words, the data distribution part 60 performs a predetermined image deformation process on the line data sent from the front end PC 50 to write the resultant line data into the buffer memory part 61. A specific technique for such an image deformation process is disclosed in, for example, Japanese Patent Application Laid-Open No. 2000-043318 filed by the assignee of the present invention.

In this manner, the angle θ of inclination of the scanning lines varies depending on the recording width w per rotation of the recording drum 10, and the image deformation process is performed in accordance with the variation in the angle θ of inclination. When the data distribution part 60 stores a plurality of line data into the buffer memory part 61, the data distribution part 60 performs the image deformation process the details of which depend on the set recording mode. To implement such an image deformation process, the data distribution part 60 is capable of holding line data corresponding to a width not less than the maximum recording width of the recording head 20. In practice, line data about a scanning line somewhat previous to the current scanning line being subjected to image recording is sent from the front end PC 50 to the data distribution part 60. However, it is assumed that such previous line data sending is not performed in the illustration using the timing diagrams of FIGS. 2, 5 and 7 for purposes of simplification. It is also assumed that an exceptional image deformation process is not performed when the data distribution part 60 stores line data into the buffer memory part 61. The above-mentioned image deformation process may be performed in the front end PC 50.

3. DETAILS OF PROCESSING IN FIRST RECORDING MODE

Figure 2:
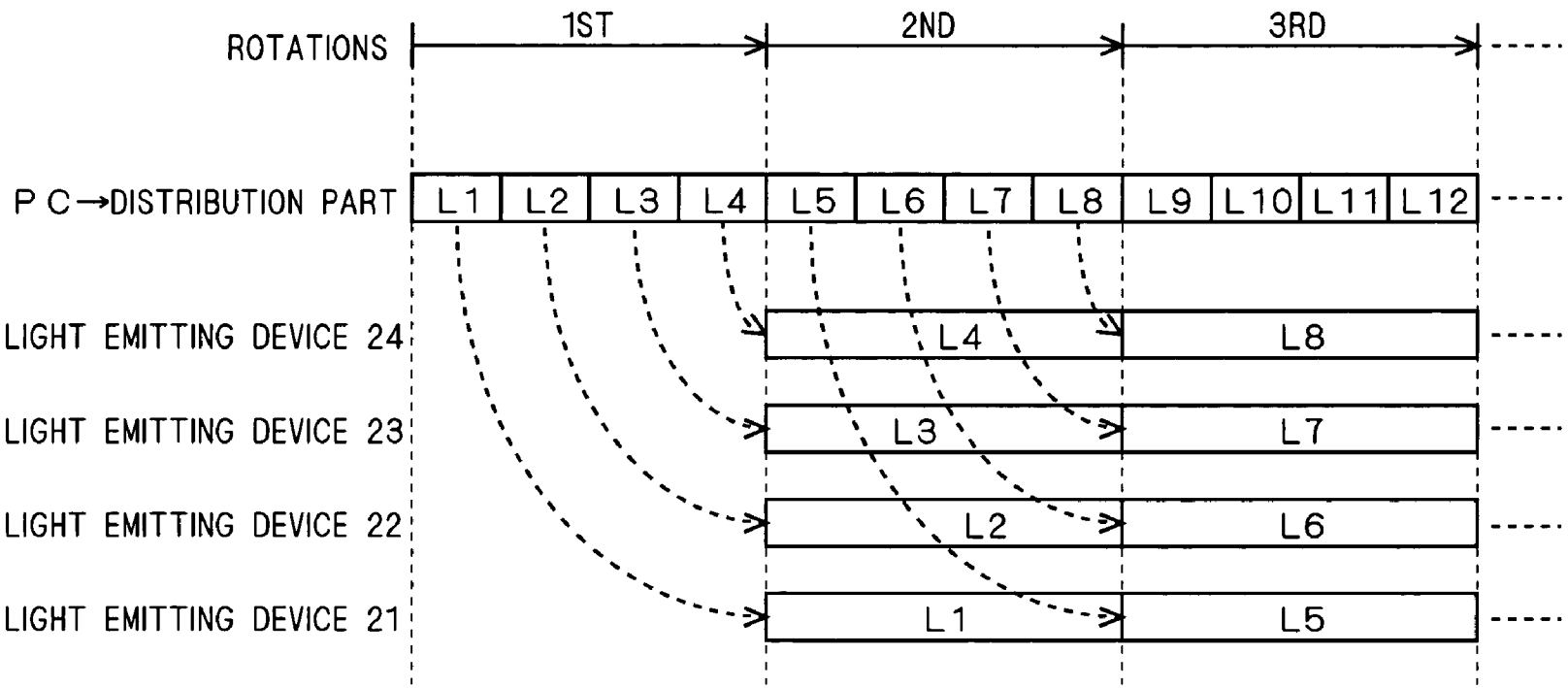
FIG. 2 is a timing diagram showing the timings of transfer and recording of line data in a first recording mode.

FIG. 2 is a timing diagram showing the timings of transfer and recording of line data when the first recording mode is selected. The timings of the rotations of the recording drum 10, the transfer of line data from the front end PC 50 to the data distribution part 60, and the recording of line data by the light emitting devices 21 to 24 are shown in a top-to-bottom sequence in FIG. 2.

Figure 3:
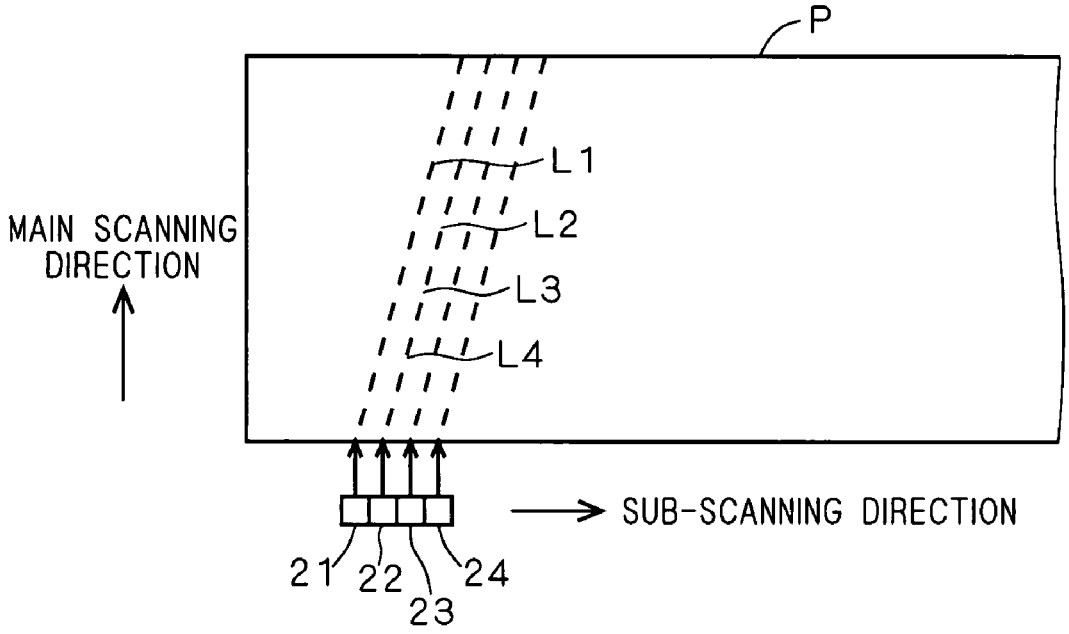
FIG. 3 shows line data recorded on a printing plate during the second rotation of a recording drum in the first recording mode.

In the first recording mode, line data L1 to L4 (four leftmost line data as viewed in FIG. 1) are sequentially transferred from the front end PC 50 to the data distribution part 60 while the recording drum 10 makes one rotation for the first time. While the recording drum 10 makes the second rotation, the line data L1 to L4 are transferred from the data distribution part 60 to the light emitting devices 21 to 24, and the transferred line data L1 to L4 are recorded on the printing plate P. A correspondence between the line data L1 to L4 and the light emitting devices to which the line data L1 to L4 are transferred is indicated by dashed arrows in FIG. 2. Specifically, the line data L1 is transferred to the light emitting device 21; the line data L2 is transferred to the light emitting device 22; the line data L3 is transferred to the light emitting device 23; and the line data L4 is transferred to the light emitting device 24. While the recording drum 10 makes one rotation, the recording head 20 moves through a distance corresponding to the recording width of the recording head 20 in the sub-scanning direction. Thus, the light emitting devices 21 to 24 emit laser light beams corresponding to the line data L1 to L4, respectively, toward the printing plate P to record the line data L1 to L4 on the printing plate P, as shown in FIG. 3.

Figure 4:
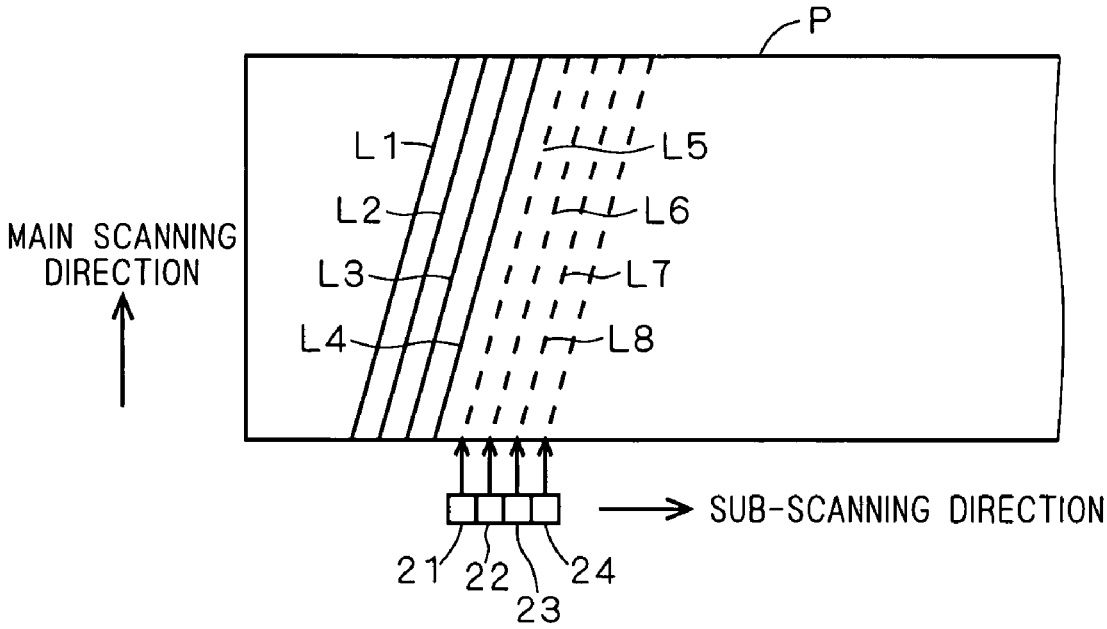
FIG. 4 shows line data recorded on the printing plate during the third rotation of the recording drum in the first recording mode.

Referring again to FIG. 2, while the recording drum 10 makes the second rotation, next line data L5 to L8 are sequentially transferred from the front end PC 50 to the data distribution part 60. While the recording drum 10 makes the third rotation, the line data L5 to L8 are transferred from the data distribution part 60 to the light emitting devices 21 to 24, and the transferred line data L5 to L8 are recorded on the printing plate P. A correspondence between the line data L5 to L8 and the light emitting devices to which the line data L5 to L8 are transferred is indicated by dashed arrows in FIG. 2. Specifically, the line data L5 is transferred to the light emitting device 21; the line data L6 is transferred to the light emitting device 22; the line data L7 is transferred to the light emitting device 23; and the line data L8 is transferred to the light emitting device 24. While the recording drum 10 makes one rotation, the recording head 20 also moves through a distance corresponding to the recording width of the recording head 20 in the sub-scanning direction. Thus, the light emitting devices 21 to 24 emit laser light beams corresponding to the line data L5 to L8, respectively, toward the printing plate P to record the line data L5 to L8 on the printing plate P, as shown in FIG. 4.

In this manner, each time the recording drum 10 makes one rotation, four line data are sequentially sent to the recording head 20 without any overlap in the first recording mode. Each time the recording drum 10 makes one rotation, the recording head 20 moves through a distance corresponding to the recording width of the recording head 20 (or the width of four line data) in the sub-scanning direction. Thus, line data are recorded in a spiral configuration on the outer peripheral surface of the recording drum 10 so that an image is recorded on the printing plate P without any break.

4. IMAGE RECORDING OPERATION IN SECOND RECORDING MODE

Figure 5:
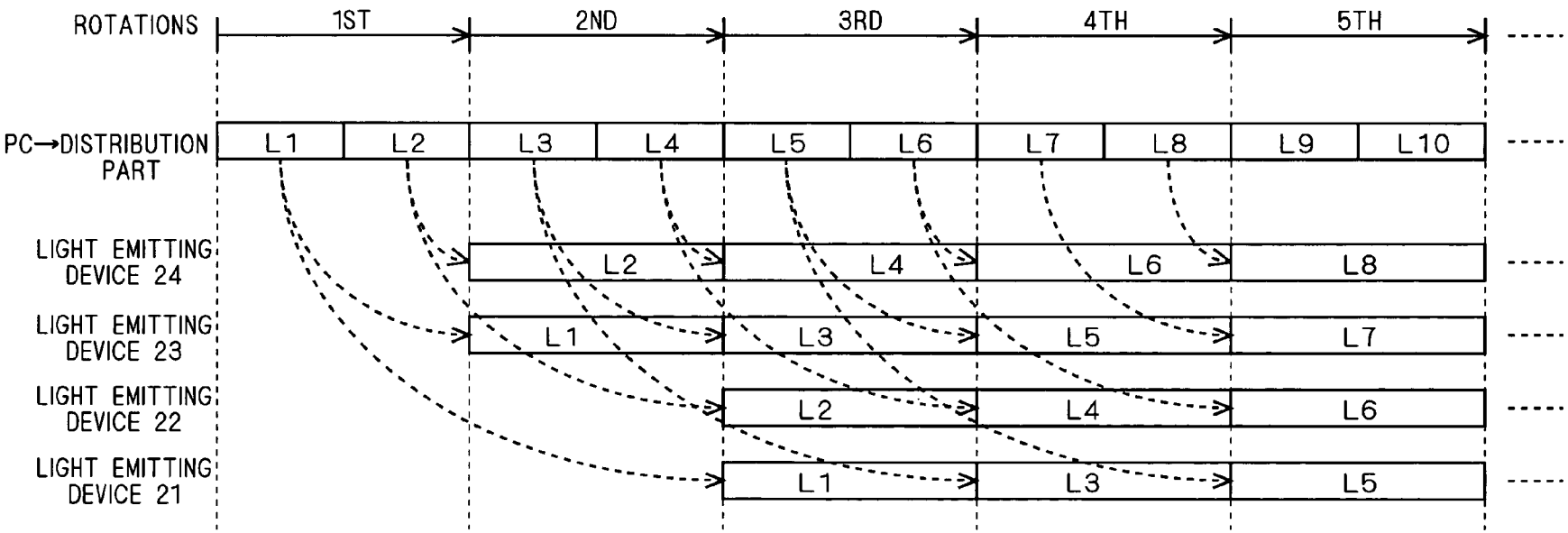
FIG. 5 is a timing diagram showing the timings of transfer and recording of line data in a second recording mode.

FIG. 5 is a timing diagram showing the timings of transfer and recording of line data when the second recording mode is selected. The timings of the rotations of the recording drum 10, the transfer of line data from the front end PC 50 to the data distribution part 60, and the recording of line data by the light emitting devices 21 to 24 are shown in a top-to-bottom sequence in FIG. 5. FIGS. 6A through 6D show the write and read operations of the buffer memory part 61 when the second recording mode is selected.

Figure 6A:
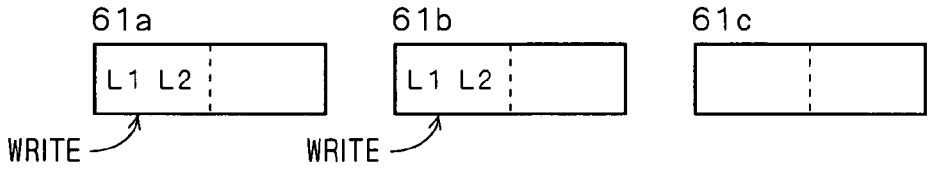
FIGS. 6A through 6D show the write and read operations of buffer memories in the second recording mode.

In the second recording mode, the line data L1 and L2 are sequentially transferred from the front end PC 50 to the data distribution part 60 while the recording drum 10 makes one rotation for the first time. The second recording mode uses three buffer memories 61*a* to 61*c* included in the data distribution part 60 for the process of transferring the line data. When the recording drum 10 makes one rotation for the first time, two copies of the line data L1 and L2 are made and written into the buffer memories 61*a* and 61*b*, as shown in FIG. 6A.

Figure 6B:
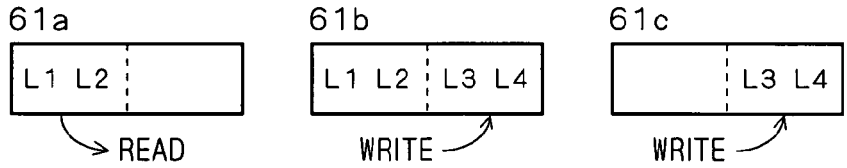
Figure 7:
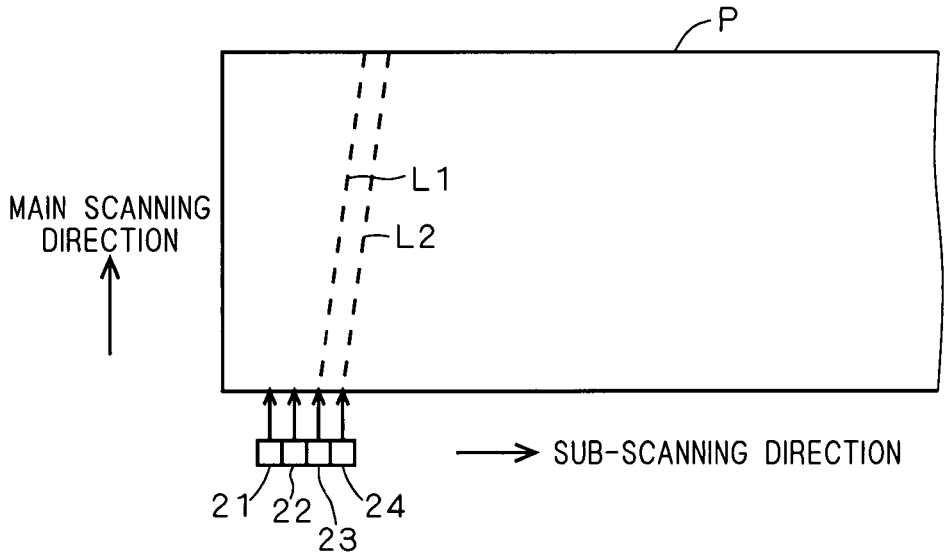
FIG. 7 shows line data recorded on the printing plate during the second rotation of the recording drum in the second recording mode.

Next, while the recording drum 10 makes the second rotation, the line data L1 and L2 are read from the buffer memory 61*a*, as shown in FIG. 6B, and transferred to the light emitting devices 23 and 24, and the transferred line data L1 and L2 are recorded on the printing plate P. A correspondence between the line data L1 and L2 and the light emitting devices to which the line data L1 and L2 are transferred is indicated by dashed arrows in FIG. 5. Specifically, the line data L1 is transferred to the light emitting device 23, and the line data L2 is transferred to the light emitting device 24. While the recording drum 10 makes one rotation, the recording head 20 moves through a distance corresponding to one half of the recording width of the recording head 20 in the sub-scanning direction. Thus, the light emitting devices 23 and 24 emit laser light beams corresponding to the line data L1 and L2, respectively, toward the printing plate P to record the line data L1 and L2 on the printing plate P, as shown in FIG. 7.

Referring again to FIG. 5, while the recording drum 10 makes the second rotation, the next line data L3 and L4 are sequentially transferred from the front end PC 50 to the data distribution part 60. Two copies of the transferred line data L3 and L4 are made and written into the buffer memories 61*b* and 61*c*, as shown in FIG. 6B.

Figure 6C:
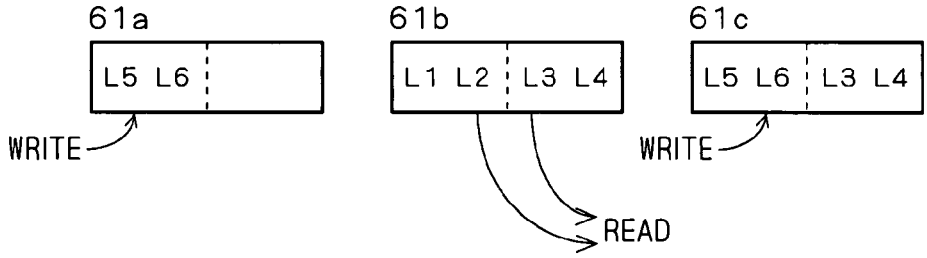
Figure 8:
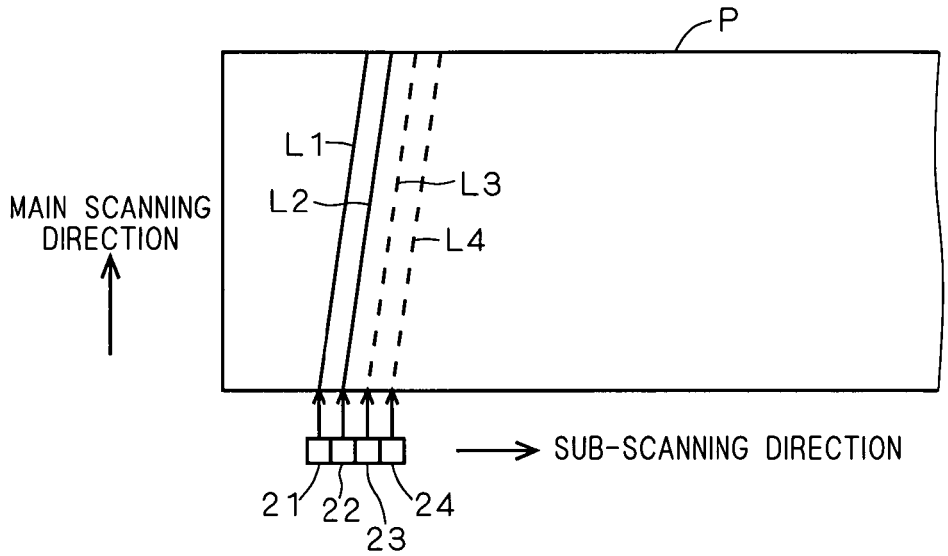
FIG. 8 shows line data recorded on the printing plate during the third rotation of the recording drum in the second recording mode.

Next, while the recording drum 10 makes the third rotation, the line data L1 to L4 are read from the buffer memory 61*b*, as shown in FIG. 6C, and transferred to the light emitting devices 21 to 24, and the transferred line data L1 to L4 are recorded on the printing plate P. A correspondence between the line data L1 to L4 and the light emitting devices to which the line data L1 to L4 are transferred is indicated by dashed arrows in FIG. 5. Specifically, the line data L1 is transferred to the light emitting device 21; the line data L2 is transferred to the light emitting device 22; the line data L3 is transferred to the light emitting device 23; and the line data L4 is transferred to the light emitting device 24. While the recording drum 10 makes one rotation, the recording head 20 also moves through a distance corresponding to one half of the recording width of the recording head 20 in the sub-scanning direction. Thus, the light emitting devices 21 to 24 emit laser light beams corresponding to the line data L1 to L4, respectively, toward the printing plate P to record the line data L1 to L4 on the printing plate P, as shown in FIG. 8. The light emitting devices 21 and 22 record the line data L1 and L2 repeatedly onto the line data L1 and L2 previously recorded on the printing plate P.

Referring again to FIG. 5, while the recording drum 10 makes the third rotation, the next line data L5 and L6 are sequentially transferred from the front end PC 50 to the data distribution part 60. Two copies of the transferred line data L5 and L6 are made and written into the buffer memories 61*a* and 61*c*, as shown in FIG. 6C.

Figure 6D:
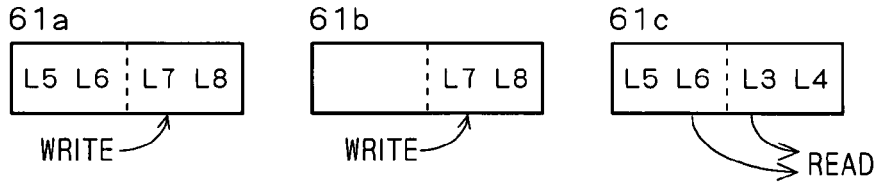
Figure 9:
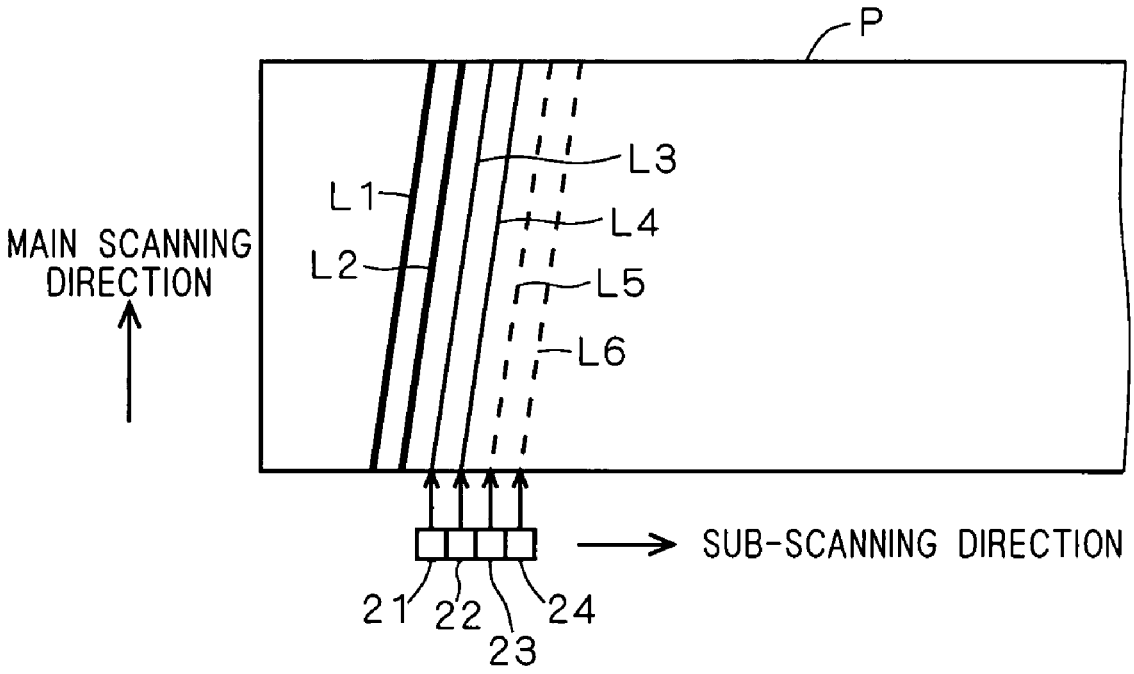
FIG. 9 shows line data recorded on the printing plate during the fourth rotation of the recording drum in the second recording mode.

Next, while the recording drum 10 makes the fourth rotation, the line data L3 to L6 are read from the buffer memory 61*c*, as shown in FIG. 6D, and transferred to the light emitting devices 21 to 24, and the transferred line data L3 to L6 are recorded on the printing plate P. A correspondence between the line data L3 to L6 and the light emitting devices to which the line data L3 to L6 are transferred is indicated by dashed arrows in FIG. 5. Specifically, the line data L3 is transferred to the light emitting device 21; the line data L4 is transferred to the light emitting device 22; the line data L5 is transferred to the light emitting device 23; and the line data L6 is transferred to the light emitting device 24. While the recording drum 10 makes one rotation, the recording head 20 also moves through a distance corresponding to one half of the recording width of the recording head 20 in the sub-scanning direction. Thus, the light emitting devices 21 to 24 emit laser light beams corresponding to the line data L3 to L6, respectively, toward the printing plate P to record the line data L3 to L6 on the printing plate P, as shown in FIG. 9. The light emitting devices 21 and 22 record the line data L3 and L4 repeatedly onto the line data L3 and L4 previously recorded on the printing plate P.

In this manner, the process of writing the same line data into two of the three buffer memories 61*a* to 61*c* and reading line data from the remaining one buffer memory is executed while the combination of the two buffer memories is changed in order in the second recording mode. Thus, the same line data as those provided to the light emitting devices 23 and 24 during the n-th rotation of the recording drum 10 are provided to the light emitting devices 21 and 22 during the (n+1)th rotation of the recording drum 10.

Each time the recording drum 10 makes one rotation, the recording head 20 moves through a distance corresponding to one half of the recording width of the recording head 20 in the sub-scanning direction. Thus, the light emitting devices 23 and 24 previously record two line data, and thereafter the following light emitting devices 21 and 22 record the same line data repeatedly at the same position. This increases the energy of the laser light beams given to the recording position on the printing plate P to accomplish the recording of an image with reliability.

5. IMAGE RECORDING OPERATION IN THIRD RECORDING MODE

Figure 10:
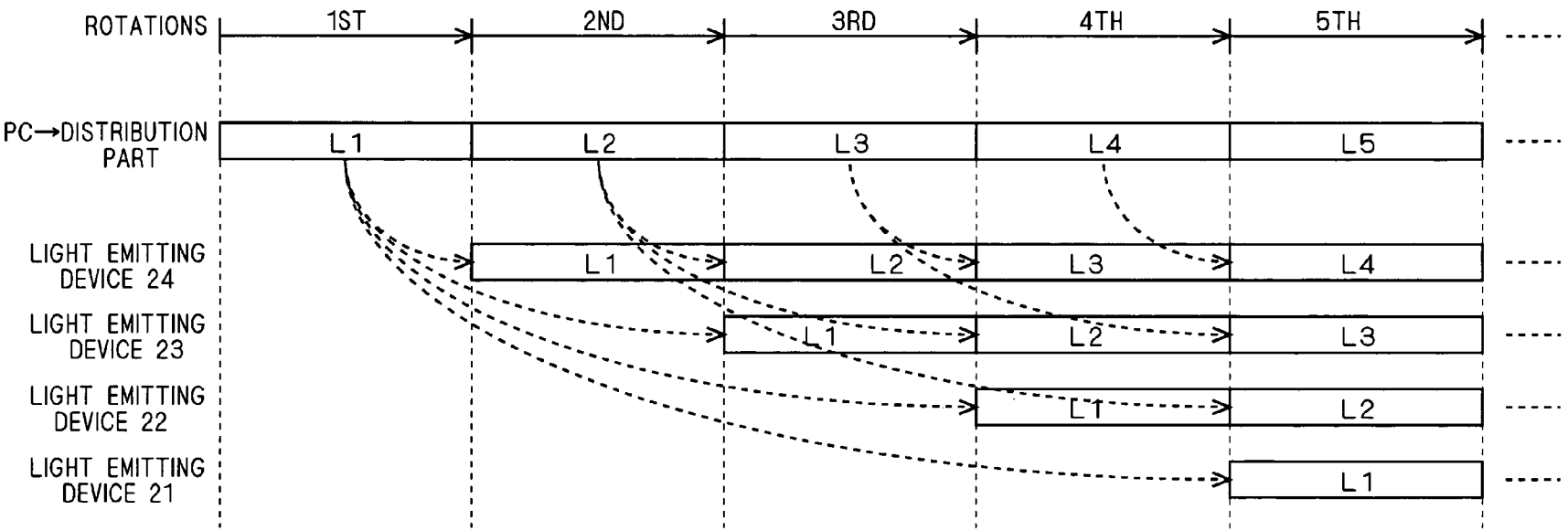
FIG. 10 is a timing diagram showing the timings of transfer and recording of line data in a third recording mode.

FIG. 10 is a timing diagram showing the timings of transfer and recording of line data when the third recording mode is selected. The timings of the rotations of the recording drum 10, the transfer of line data from the front end PC 50 to the data distribution part 60, and the recording of line data by the light emitting devices 21 to 24 are shown in a top-to-bottom sequence in FIG. 10. FIGS. 11A through 11D show the write and read operations of the buffer memory part 61 when the third recording mode is selected.

In the third recording mode, the line data L1 is transferred from the front end PC 50 to the data distribution part 60 while the recording drum 10 makes one rotation for the first time. The third recording mode uses five buffer memories 61*a* to 61*e* included in the data distribution part 60 for the process of transferring the line data. When the recording drum 10 makes one rotation for the first time, four copies of the line data L1 are made and written into the buffer memories 61*a* to 61*d*, as shown in FIG. 11A.

Figures 11A, 11B, 11C, 11D:
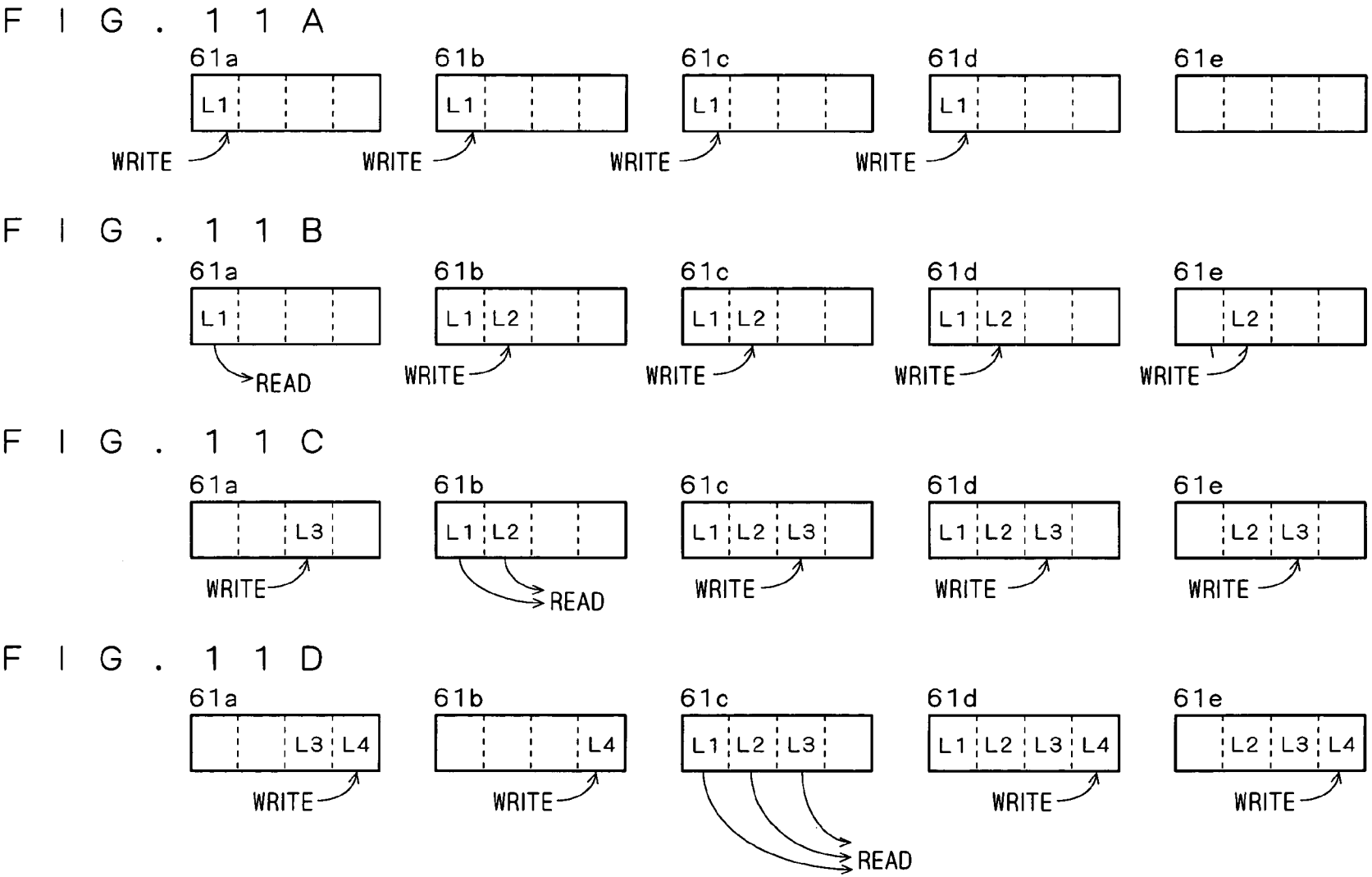
FIGS. 11A through 11D show the write and read operations of buffer memories in the third recording mode.
Figure 12:
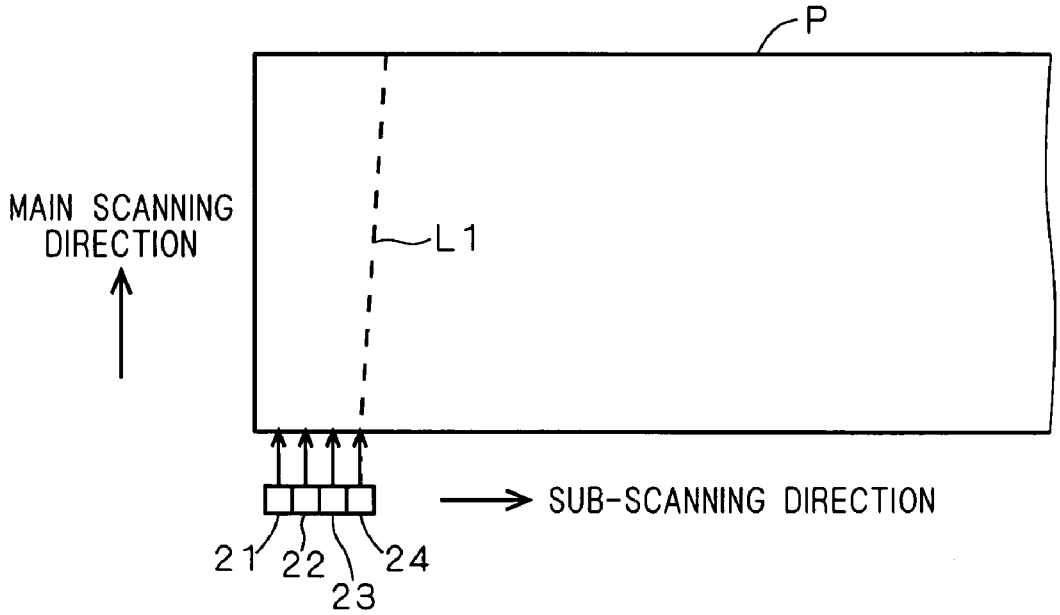
FIG. 12 shows line data recorded on the printing plate during the second rotation of the recording drum in the third recording mode.

Next, while the recording drum 10 makes the second rotation, the line data L1 is read from the buffer memory 61*a*, as shown in FIG. 11B, and transferred to the light emitting device 24, and the transferred line data L1 is recorded on the printing plate P. While the recording drum 10 makes one rotation, the recording head 20 moves through a distance corresponding to one quarter of the recording width of the recording head 20 in the sub-scanning direction. Thus, the light emitting device 24 emits a laser light beam corresponding to the line data L1 toward the printing plate P to record the line data L1 on the printing plate P, as shown in FIG. 12.

Referring again to FIG. 10, while the recording drum 10 makes the second rotation, the line data L2 is transferred from the front end PC 50 to the data distribution part 60. Four copies of the transferred line data L2 are made and written into the buffer memories 61*b* to 61*e*, as shown in FIG. 11B.

Figure 13:
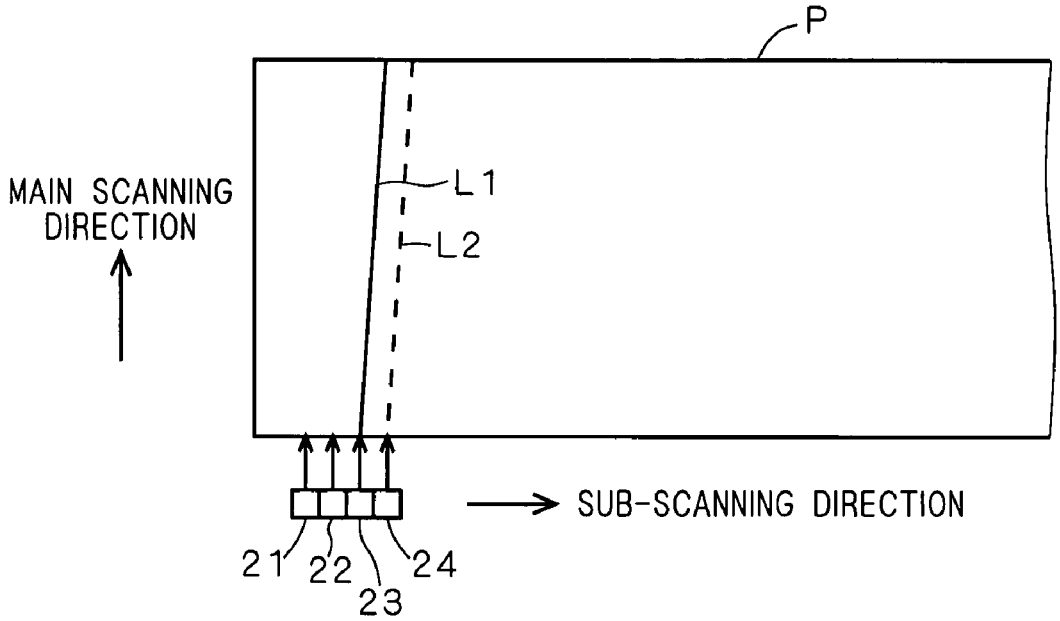
FIG. 13 shows line data recorded on the printing plate during the third rotation of the recording drum in the third recording mode.

Next, while the recording drum 10 makes the third rotation, the line data L1 and L2 are read from the buffer memory 61*b*, as shown in FIG. 11C, and transferred to the light emitting devices 23 and 24, and the transferred line data L1 and L2 are recorded on the printing plate P. A correspondence between the line data L1 and L2 and the light emitting devices to which the line data L1 and L2 are transferred is indicated by dashed arrows in FIG. 10. Specifically, the line data L1 is transferred to the light emitting device 23, and the line data L2 is transferred to the light emitting device 24. While the recording drum 10 makes one rotation, the recording head 20 also moves through a distance corresponding to one quarter of the recording width of the recording head 20 in the sub-scanning direction. Thus, the light emitting devices 23 and 24 emit laser light beams corresponding to the line data L1 and L2, respectively, toward the printing plate P to record the line data L1 and L2 on the printing plate P, as shown in FIG. 13. The light emitting device 23 records the line data L1 repeatedly onto the line data L1 previously recorded on the printing plate P.

Referring again to FIG. 10, while the recording drum 10 makes the third rotation, the line data L3 is transferred from the front end PC 50 to the data distribution part 60. Four copies of the transferred line data L3 are made and written into the buffer memories 61*a*, 61*c*, 61*d* and 61*e*, as shown in FIG. 11C.

Figure 14:
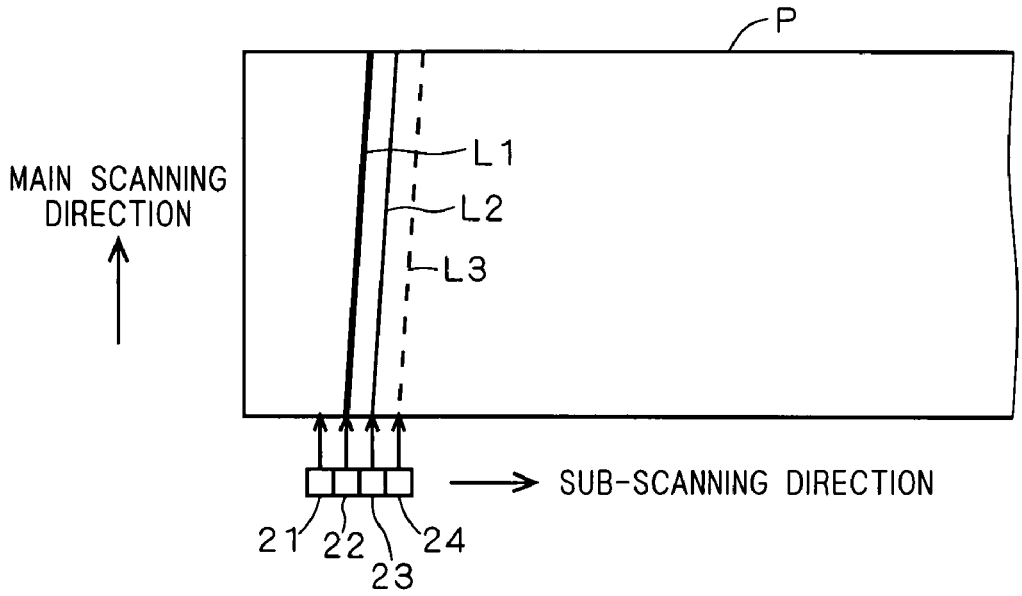
FIG. 14 shows line data recorded on the printing plate during the fourth rotation of the recording drum in the third recording mode.

Next, while the recording drum 10 makes the fourth rotation, the line data L1 to L3 are read from the buffer memory 61*c*, as shown in FIG. 11D, and transferred to the light emitting devices 22 to 24, and the transferred line data L1 to L3 are recorded on the printing plate P. A correspondence between the line data L1 to L3 and the light emitting devices to which the line data L1 to L3 are transferred is indicated by dashed arrows in FIG. 10. Specifically, the line data L1 is transferred to the light emitting device 22; the line data L2 is transferred to the light emitting device 23; and the line data L3 is transferred to the light emitting device 24. While the recording drum 10 makes one rotation, the recording head 20 also moves through a distance corresponding to one quarter of the recording width of the recording head 20 in the sub-scanning direction. Thus, the light emitting devices 22 to 24 emit laser light beams corresponding to the line data L1 to L3, respectively, toward the printing plate P to record the line data L1 to L3 on the printing plate P, as shown in FIG. 14. The light emitting devices 22 and 23 record the line data L1 and L2 repeatedly onto the line data L1 and L2 previously recorded on the printing plate P.

Subsequently, line data are sequentially transferred from the front end PC 50 to the data distribution part 60 while the recording drum 10 makes one rotation. The data distribution part 60 performs the process of writing the same line data into four of the five buffer memories 61*a* to 61*e* and reading line data from the remaining one buffer memory while changing the combination of the four buffer memories in order. Thus, the same line data is repeatedly provided to the four light emitting devices 21 to 24.

Each time the recording drum 10 makes one rotation, the recording head 20 moves through a distance corresponding to one quarter of the recording width of the recording head 20 in the sub-scanning direction. Thus, the light emitting device 24 previously records line data, and thereafter the following light emitting devices 23, 22 and 21 sequentially record the same line data at the same position. This increases the energy of the laser light beams given to the recording position on the printing plate P to accomplish the recording of an image with reliability.

6. GENERALIZATION AND MODIFICATIONS OF THE INVENTION

The above-mentioned preferred embodiment is described by taking the recording head 20 including the four light emitting devices 21 to 24 as an example. The number of light emitting devices included in the recording head according to the present invention is not limited to four as described above. The present invention is generally applicable to a recording head including a plurality of light emitting devices. For example, the number of light emitting devices included in the recording head may be 16 or 32. Also, a plurality of light emitting devices may be located over a plurality of recording heads.

In the above-mentioned second recording mode, each time the recording drum 10 makes one rotation, the recording head 20 moves through a distance corresponding to one half of the recording width of the recording head 20 in the sub-scanning direction, to thereby make two repeated recordings at the same position on the printing plate P. However, the number of repeated recordings made according to the present invention is not limited to two. The recording head 20 may be adapted to move through a distance corresponding to one N-th of the recording width of the recording head 20 in the sub-scanning direction each time the recording drum 10 makes one rotation, thereby making N repeated recordings at the same position on the printing plate P, where N is an integer not less than 2. This increases the energy of the laser light beams given to the recording position on the printing plate P to accomplish the recording of an image with reliability. The recording speed is not extremely decreased because not all light emitting devices are used to make the repeated recordings at the same position on the printing plate P. Further, the construction of optical systems and driving systems in the image recording apparatus is not complicated.

It is, however, desirable that the above-mentioned integer N is a submultiple of the number of light emitting devices included in the recording head 20. Defining the integer N as a submultiple of the number of light emitting devices enables all of the light emitting devices included in the recording head 20 to be used without any useless remainder light emitting device. As an example, when 16 light emitting devices in the recording head are arranged in the sub-scanning direction, it is desirable to set the value of N at two, four or eight so that the number of repeated recordings is two, four or eight.

Additionally, the value of N may be selectively settable in the mode setting part 30. For example, the mode setting part 30 may be adapted to automatically set the value of N, based on the inputted information about the sensitivity of the printing plate P, a recording intensity, and the like. Thus, the image recording apparatus 1 is capable of setting the value of N at a high value to increase the number of repeated recordings when the sensitivity of the printing plate P is low or when a high recording intensity is required. The image recording apparatus 1 is also capable of setting the value of N at a low value to improve the recording speed when the sensitivity of the printing plate P is high or when a not-so-high recording intensity is required. Also, the input part 31 and the mode setting part 30 may be configured so that information about the recording mode is directly inputted from the input part 31.

The image recording apparatus 1 may be capable of switching between a recording mode in which the recording head 20 moves through a distance corresponding to the recording width of the recording head 20 in the sub-scanning direction each time the recording head 20 makes a single scan in the main scanning direction and another recording mode in which the recording head 20 moves through a distance corresponding to one N-th of the recording width of the recording head 20 in the sub-scanning direction each time the recording head 20 makes a single scan in the main scanning direction, such as between the above-mentioned first recording mode and the above-mentioned second recording mode. Thus, whether to make the repeated recordings on the printing plate P or not is selectable depending on various conditions.

Also, the image recording apparatus 1 may be capable of switching between a recording mode in which the recording head 20 moves through a distance corresponding to one N-th of the recording width of the recording head 20 in the sub-scanning direction each time the recording head 20 makes a single scan in the main scanning direction and another recording mode in which the recording head 20 moves through a distance corresponding to one M-th of the recording width of the recording head 20 in the sub-scanning direction (where M is the number of light emitting devices arranged in the sub-scanning direction in the recording head) each time the recording head 20 makes a single scan in the main scanning direction, such as between the above-mentioned second recording mode and the above-mentioned third recording mode. Thus, the number of repeated recordings on the printing plate P is selectable depending on various conditions.

Similarly, the image recording apparatus 1 may be capable of switching between a recording mode in which the recording head 20 moves through a distance corresponding to the recording width of the recording head 20 in the sub-scanning direction each time the recording head 20 makes a single scan in the main scanning direction and another recording mode in which the recording head 20 moves through a distance corresponding to one M-th of the recording width of the recording head 20 in the sub-scanning direction each time the recording head 20 makes a single scan in the main scanning direction, such as between the above-mentioned first recording mode and the above-mentioned third recording mode. Thus, the number of repeated recordings on the printing plate P is selectable depending on various conditions.

For N repeated recordings, it is desirable to use (N+1) buffer memories 61*a*, 61*b*, . . . included in the data distribution part 60 and perform the process of writing the same line data into N out of the (N+1) buffer memories and reading line data from the remaining one buffer memory while changing the combination of the N buffer memories in order. This easily accomplishes the provision of the same line data repeatedly N times to the plurality of light emitting devices included in the recording head 20.

The above-mentioned image recording apparatus 1 is of the type in which the sub-scanning is done continuously so that the line data are recorded in a spiral configuration on the outer peripheral surface of the recording drum 10. The image recording apparatus according to the present invention may be a step feed type image recording apparatus in which the sub-scanning is done intermittently in synchronism with the rotation of the recording drum 10. It is unnecessary for the step feed type image recording apparatus to change the angle of inclination of the line data in accordance with the recording mode. This facilitates the data processing in the data distribution part 60.

The above-mentioned image recording apparatus 1 is of the type which irradiates the same position on the printing plate P repeatedly with the laser light beams having the same intensity, but may be configured to make repeated recordings at the same position on the printing plate P while changing the intensity of a laser light beam. This accomplishes the recording of a multi-level gradation image on the printing plate P. As an example, repeating the irradiation N times by a light emitting device capable of changing the emission intensity in m levels accomplishes the recording with m×N levels of intensity on the printing plate P.

In the above-mentioned preferred embodiment, the buffer memory part 61 is provided in the image recording apparatus 1, and the same image data is read repeatedly from the buffer memory part 61 for the repeated recordings. It is hence necessary to transmit the same line data only once from the front end PC 50 to the image recording apparatus 1. The image deformation process in accordance with the recording mode is also carried out in the data distribution part 60. It is hence unnecessary for the front end PC 50 to deform the data for transfer in accordance with the recording mode.

Figure 15:
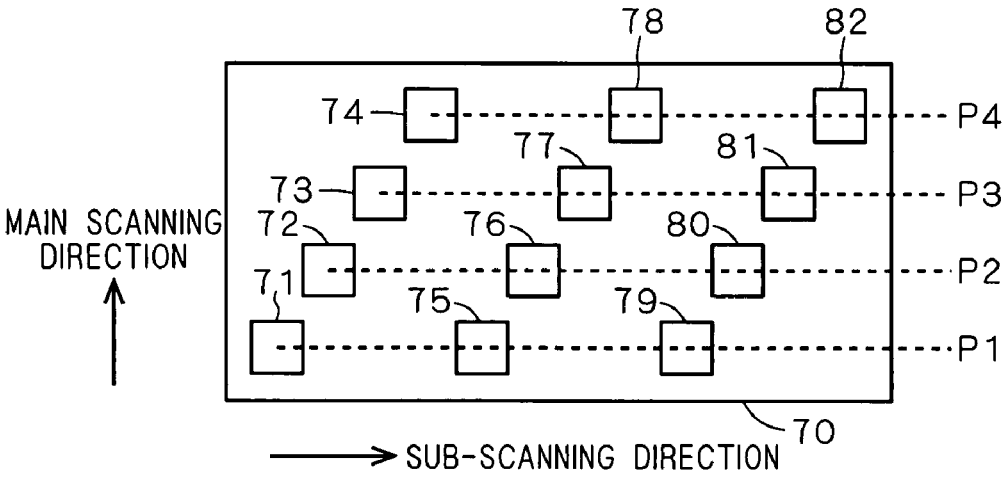
FIG. 15 shows a recording head including a two-dimensional array of light emitting devices.

The plurality of light emitting devices 21 to 24 are arranged in a row in the recording head 20 according to the above-mentioned preferred embodiment. Alternatively, a plurality of light emitting devices 71 to 82 may be arranged in a two-dimensional array in a recording head 70, as shown in FIG. 15. In the recording head 70 shown in FIG. 15, the light emitting devices 71, 75 and 79 are disposed in a first main scanning position P1; the light emitting devices 72, 76 and 80 are disposed in a second main scanning position P2; the light emitting devices 73, 77 and 81 are disposed in a third main scanning position P3; and the light emitting devices 74, 78 and 82 are disposed in a fourth main scanning position P4. When the light emitting devices 71 to 82 are arranged in such a two-dimensional array, there has been a conventional problem such that variations in recording intensity on the printing plate P result from the different main scanning positions of the light emitting devices 71 to 82.

Specifically, the light emitting devices 74, 78 and 82 disposed in the fourth main scanning position P4 are in the forwardmost position as viewed in the main scanning direction. For this reason, the light emitting devices 74, 78 and 82 record an image on a region of the printing plate P which is not previously heated by other light emitting devices. In contrast to this, the light emitting devices 73, 77 and 81 disposed in the third main scanning position P3 are positioned behind the light emitting devices 74, 78 and 82 as viewed in the main scanning direction. For this reason, the light emitting devices 73, 77 and 81 record an image on a region of the printing plate P near the region already heated by laser light beams directed from the light emitting devices 74, 78 and 82. Thus, more heat energy is provided to the region of the printing plate P irradiated with the laser light beams from the light emitting devices 73, 77 and 81 disposed in the third main scanning position P3 than to the region of the printing plate P irradiated with the laser light beams from the light emitting devices 74, 78 and 82 disposed in the fourth main scanning position P4. Similarly, more heat energy is provided to a region of the printing plate P irradiated with the laser light beams from the light emitting devices 72, 76 and 80 disposed in the second main scanning position P2 than to the region of the printing plate P irradiated with the laser light beams from the light emitting devices disposed in the third or fourth main scanning position P3 or P4, and more heat energy is provided to a region of the printing plate P irradiated with the laser light beams from the light emitting devices 71, 75 and 79 disposed in the first main scanning position P1 than to the region of the printing plate P irradiated with the laser light beams from the light emitting devices disposed in the second, third or fourth main scanning position P2, P3 or P4. This phenomenon grows in proportion to the size of the recording head in the main scanning direction.

When image recording is performed in such a manner that the recording head 70 moves through a distance corresponding to the recording width of the recording head 70 in the sub-scanning direction each time the recording head 70 makes a single scan in the main scanning direction, a scanning line formed by a light emitting device (e.g., the light emitting device 74) disposed in the forwardmost position as viewed in the main scanning direction and a scanning line formed by a light emitting device (e.g., the light emitting device 75) disposed in the rearwardmost position are adjacent to each other on the printing plate P. An increased difference between these scanning lines in depth, density, line width or the like due to the difference in heat energy provided from the light emitting devices is visually perceived as an image defect (or banding) occurring periodically in the recorded image formed on the printing plate P to result in the deterioration of the quality of the recorded image.

Figure 16:
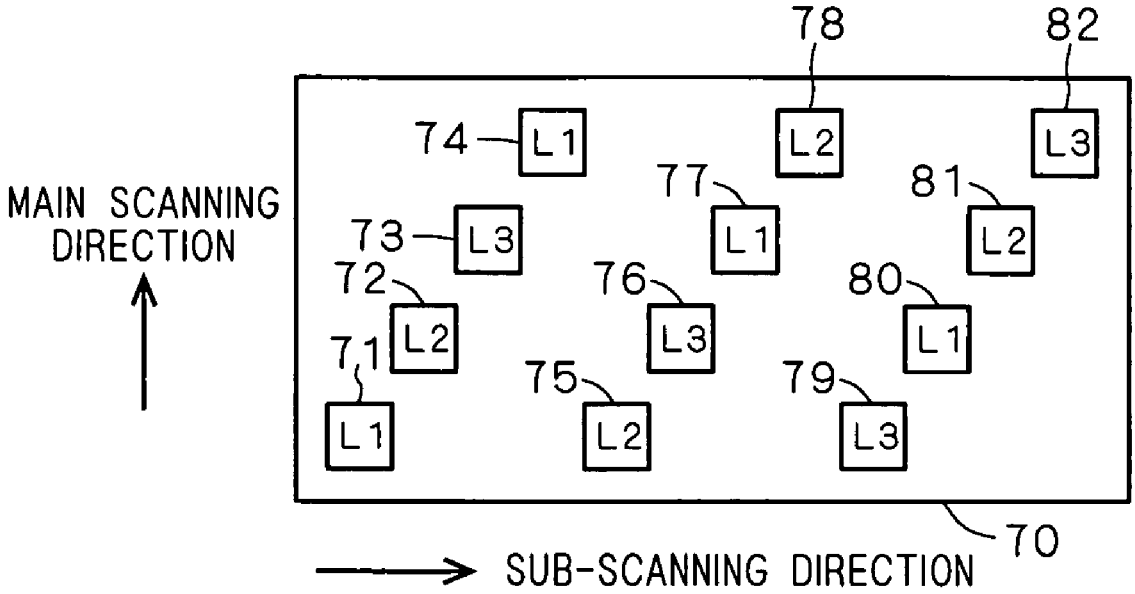
FIG. 16 shows an example of line data provided to the light emitting devices when four repeated recordings are made using the recording head including the two-dimensional array of light emitting devices.

FIG. 16 shows an example of line data provided to the light emitting devices when four repeated recordings are made using such a recording head 70. As shown in FIG. 16, the line data L1 is repeatedly recorded by the light emitting devices 80, 77, 74 and 71 disposed in the different main scanning positions. Similarly, the line data L2 is repeatedly recorded by the light emitting devices 81, 78, 75 and 72 disposed in the different main scanning positions, and the line data L3 is repeatedly recorded by the light emitting devices 82, 79, 76 and 73 disposed in the different main scanning positions. In other words, the recording head 70 uses a light emitting device disposed in each of the main scanning positions P1 to P4 to make recording once at the same position on the printing plate P. This alleviates the variations in recording intensity resulting from the different main scanning positions of the light emitting devices 71 to 82 in the recording head 70. The result is the uniform depth, density and line width of the scanning lines formed on the printing plate P to eliminates the image defect (or banding) which has occurred periodically in the recorded image. Therefore, the quality of the recorded image is improved.

The above-described image recording apparatus 1 is of the type which irradiates the printing plate P with the laser light beam to make the surface of the printing plate P uneven (or to engrave the printing plate P), thereby recording an image on the printing plate P. The image recording apparatus according to the present invention, however, may be of other types to record an image on a printing plate. For example, the image recording apparatus may be of the type which irradiates a printing plate with a laser light beam to remove a black layer formed on the surface of the printing plate, thereby recording an image on the printing plate.

While the invention has been described in detail, the foregoing description is in all aspects illustrative and not restrictive. It is understood that numerous other modifications and variations can be devised without departing from the scope of the invention.

What is claimed is:

1. An image recording apparatus for recording an image on a recording medium by scanning a surface of the recording medium with a light beam, comprising a recording head including a plurality of light sources each for emitting a light beam toward the recording medium;

a moving part for moving said recording head relative to the recording medium in a main scanning direction and in a sub-scanning direction orthogonal to said main scanning direction; and a controller for controlling said moving part;

a setting part for selecting a first integer N from a group of submultiples of a second integer M, based on information about the sensitivity of the recording medium or a recording intensity, where the second integer M is the number of light sources arranged in said recording head in the sub-scanning direction, and said group of submultiples of the second integer M includes at least two submultiples of the second integer M; wherein said controller controls said moving part so that said recording head moves through a distance corresponding to one N-th of a recording width of said recording head in said sub-scanning direction each time said recording head makes a single scan in said main scanning direction, to thereby cause said recording head to make N repeated recordings at the same position on the recording medium.

2. The image recording apparatus according to claim 1, further comprising a distribution part for distributing data to said light sources so that said recording head records the same data at the same position on the recording medium.

3. The image recording apparatus according to claim 2, wherein said distribution part includes (N+1) buffers for temporarily holding data to provide the data to said light sources, and performs the process of writing the same data into N out of the (N+1) buffers and reading data from the remaining one buffer while changing the combination of the N buffers in order.

4. The image recording apparatus according to claim 1, wherein each of said light sources is capable of continuously changing the intensity of the light beam.

5. The image recording apparatus according to claim 1, wherein said light sources are arranged in a two-dimensional array extending in said main scanning direction and in said sub-scanning direction in said recording head, and said recording head uses some of said light sources different in main scanning position from each other to make repeated recordings at the same position on the recording medium.

6. The image recording apparatus according to claim 5, wherein said light sources are distributed to and disposed in a predetermined number of main scanning positions in said recording head, and said recording head uses at least some of said light sources disposed in all of said main scanning positions to make repeated recordings at the same position on the recording medium.

7. A method of recording an image on a recording medium by scanning a surface of the recording medium with a light beam, comprising the steps of:

(a) setting the recording medium in a position opposed to a recording head including a plurality of light sources;

(b) selecting a first integer N from a group of submultiples of a second integer M, based on information about the sensitivity of the recording medium or a recording intensity, where the second integer M is the number of light sources arranged in said recording head in the sub-scanning direction, and said group of submultiples of the second integer M includes at least two submultiples of the second integer M; and (c) emitting a light beam from said recording head toward the recording medium while moving said recording head relative to the recording medium in a main scanning direction and in a sub-scanning direction orthogonal to said main scanning direction wherein in said step (c), said recording head is moved through a distance corresponding to one N-th of a recording width of said recording head in said sub-scanning direction each time said recording head makes a single scan in said main scanning direction, to thereby make N repeated recordings at the same position on the recording medium.

* * * * *